US005815193A

United States Patent [19]

Clevinger

[11] Patent Number: 5,815,193

[45] Date of Patent: Sep. 29, 1998

[54] PRINTING WITH SEALABLE HOUSING AND ADJUSTABLE BACK-UP PLATE AND METHOD THEREFOR

[75] Inventor: Anthony Lydale Clevinger, Glen Ellyn, Ill.

[73] Assignee: Illinois Tool Works Inc., Glenview, Ill.

[21] Appl. No.: 984,461

[22] Filed: Dec. 3, 1997

[51] Int. Cl.[6] ..... B41J 11/14; B41J 11/20; B41J 29/02

[52] U.S. Cl. ..... 347/222; 347/220; 400/649; 400/648; 400/691; 400/693

[58] Field of Search ..... 347/220, 222; 400/691, 693, 648, 649

[56] References Cited

U.S. PATENT DOCUMENTS 4,868,676 9/1989 Matsuura et al. ..... 347/222

FOREIGN PATENT DOCUMENTS 0683055 11/1995 European Pat. Off. .

*Primary Examiner*—Huan H. Tran

[57] ABSTRACT

A printer system and method for sealing a printer system within a housing by moving a back-up plate toward a print head access opening of the housing and into engagement with a first perimeter thereof to sealingly close the housing, whereby the printer system is sealingly enclosable within the housing when not printing. The printer system includes a main plate assembly supporting a print head removably mountable in an opening of the housing, and matably engageable with at least a portion thereof to form a seal therebetween, and a cassette assembly mountable onto the main plate assembly and matably engagable with a cassette access opening of the housing to form a seal therebetween. A back-up plate is adjustably alignable relative to a print head by moving it into engagement with a print head access opening of a housing, fixing the alignment thereof, and then moving the aligned back-up plate away from the housing for printing operations.

20 Claims, 4 Drawing Sheets

PRINTING WITH SEALABLE HOUSING AND ADJUSTABLE BACK-UP PLATE AND METHOD THEREFOR

CROSS REFERENCE TO RELATED APPLICATIONS

The present application is related to copending U.S. application Ser. No. 08/934,718 entitled "Bi-Directional Thermal Printer and Method Therefor", and copending U.S. application Ser. No. 08/984,445 entitled "Printer with Dancer Arm and Reel Brake and Method Therefor" both filed contemporaneously and assigned commonly herewith, and incorporated by reference herein.

BACKGROUND OF THE INVENTION

The invention relates generally to product and coding and marking operations, and more particularly to systems and methods for sealing printer systems in a housing and adjustably aligning a back-up plate relative to a print head thereof.

Many product coding and marking operations are performed along production lines and under conditions where the printer system performing the operations is exposed to a variety of elements that may have an adverse affect thereon. This is particularly true in applications or environments having substantial amounts of airborne particulate matter or other contaminants, and in the food and beverage industries, among others.

In many printer systems, a print head transfers ink onto a target area of the product or package, referred to herein as a substrate, positioned adjacent a backup plate, which provides support thereto during the printing operation. In thermal printers and many hot stamp imprinters, for example, ink is transferred from an inked ribbon or foil, usually drawn under tension from an unwind reel by a rewind reel or a feed roller, positioned adjacent the substrate and the back-up plate.

It is necessary generally to accurately align the back-up plate relative to the print head to ensure proper printing onto the substrate. The alignment is especially important in thermal and other printer systems having a print head that sweeps along a path relative to the back-up plate. Alignment of known back-up plates however is generally an arduous task, especially in applications where the print head is reconfigured frequently, which may require tools and in extreme cases the skill of a technician. Many operators of printer systems used in coding and marking operations, are not generally familiar with the intricacies of system operation, and to some extent decisions to use or purchase one system or another may be based on its ease of operation, or user friendliness.

The present invention is drawn toward advancements in the art of coding and marking operations, and more particularly to systems and methods for sealing printer systems in a housing and providing an adjustably alignable back-up plate relative to a print head thereof.

It is thus an object of the present invention to provide novel printer systems and methods therefor that overcome problems in the prior art.

It is also an object of the invention to provide novel printer systems and methods for at least partially housing a printer system in a housing during printing operations, and sealing the printer system within the housing when the printer is not being utilized.

It is a more particular object of the invention to provide novel printer systems and methods for sealing a printer system within a housing by moving a back-up plate toward a print head access opening of the housing and into engagement with a first perimeter thereof to sealingly close the housing, whereby the printer system is sealingly enclosable within the housing when not in use.

It is another more particular object of the invention to provide novel printer systems and methods for sealing a printer system having a main plate assembly supporting a print head removably mountable in a first opening of a housing, and matably engagable with at least a portion thereof to form a seal therebetween. The printer system also includes a cassette assembly removably mountable onto the main plate assembly and matably engagable with a cassette access opening of the housing and with the main plate assembly to form a seal therebetween.

It is another object of the invention to provide novel printer systems and methods for adjustably aligning a back-up plate relative to a print head relatively easily, and more particularly aligning the back-up plate by moving it toward and into engagement with a print head access opening of a housing, and then fixing the alignment thereof before moving the aligned back-up plate away from the housing for printing operations, without requiring any tools or expertise.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
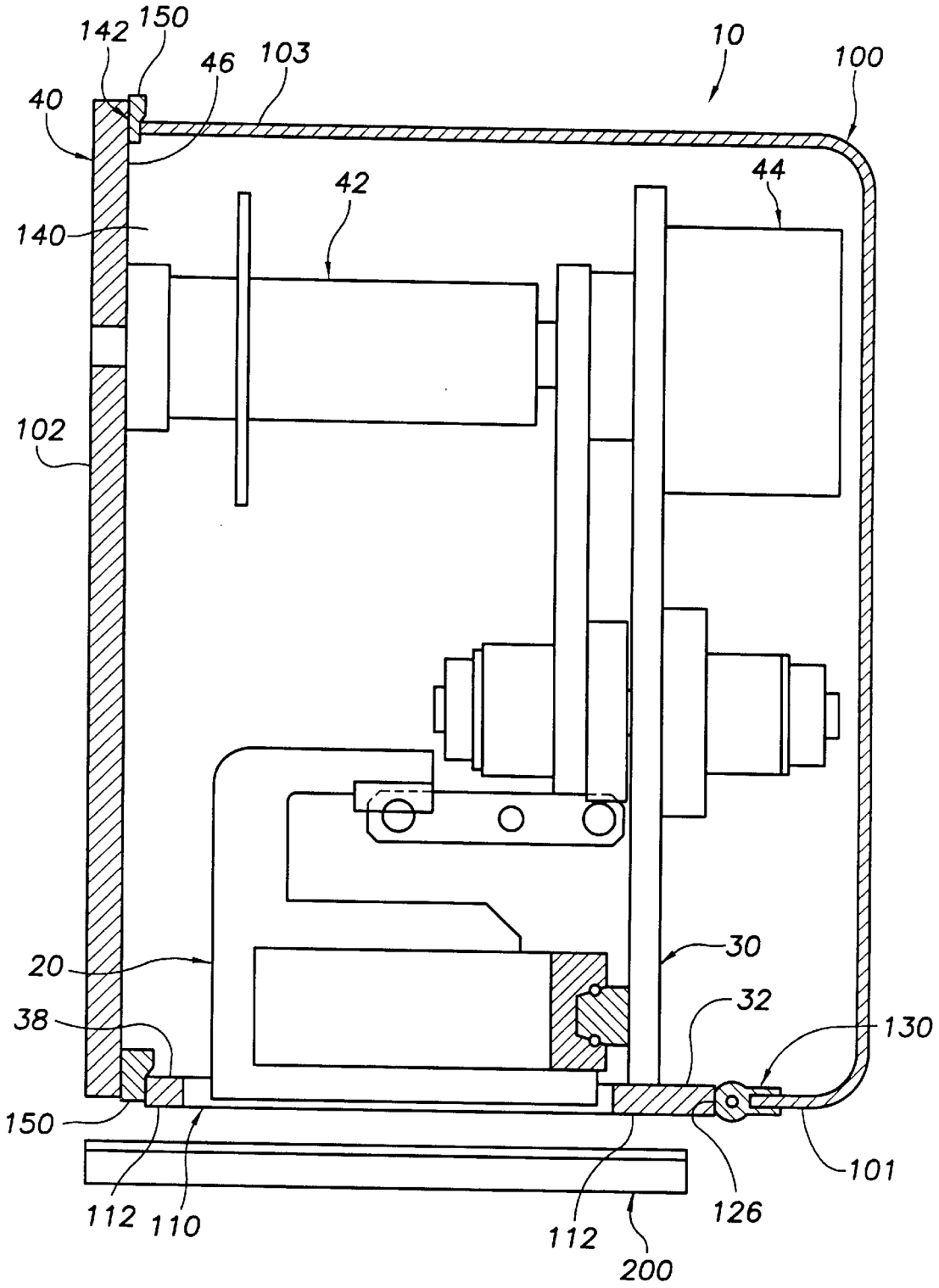
FIG. 1 is a partial side elevational view of a modular printer disposed in a sealable housing according to an exemplary embodiment of the invention.
Figure 2A:
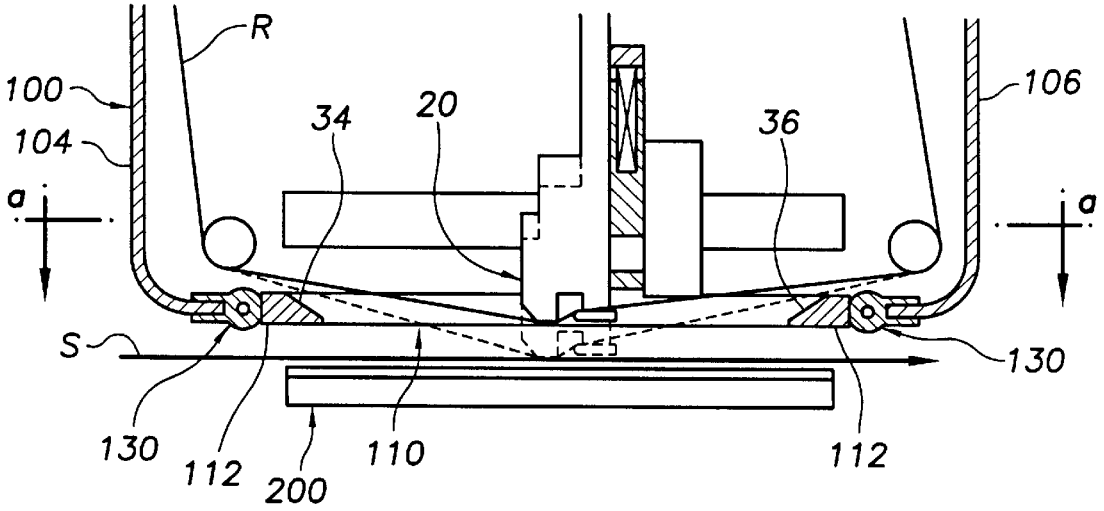
FIG. 2*a* is a partial front elevational view of the printer and housing of FIG. 1.
Figure 2B:
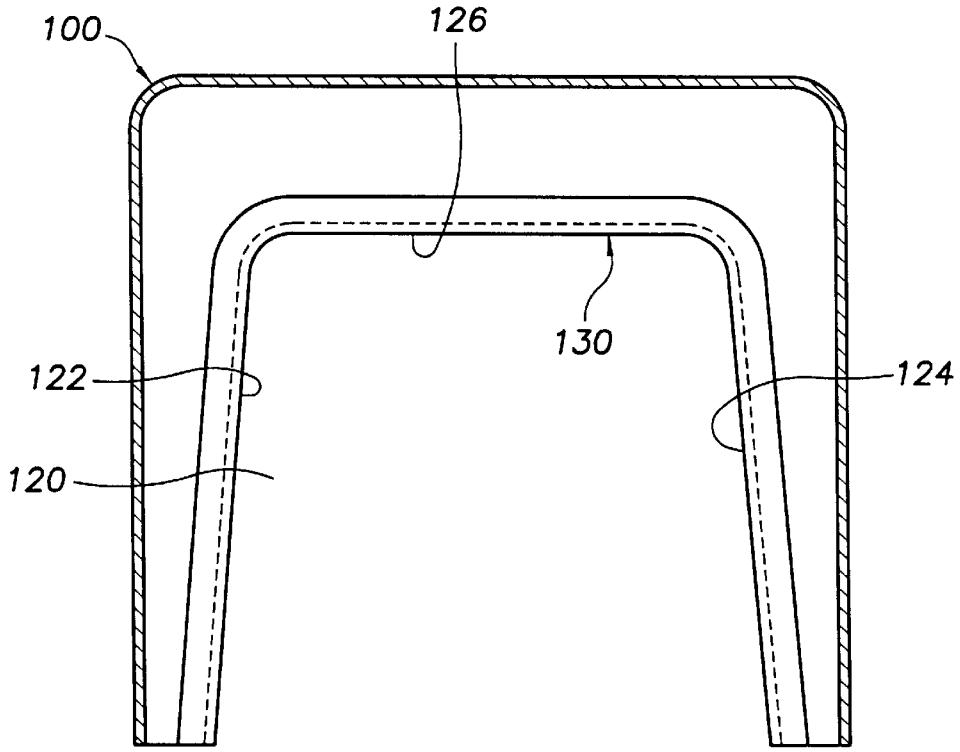
FIG. 2*b* is a partial top plan view along lines a—a of the housing of FIG. 2*a*.

FIGS. 1, 2*a* and 2*b* illustrate a printer system 10 useable for printing onto a substrate, especially in coding and marking operations. The system 10 includes a print head 20 disposed in a housing 100 having a print head access opening 110 with a first perimeter 112 on a first side portion 101 thereof. The exemplary print head 20 is actuatably protrudable through the print head opening 110, shown best in FIG. 2*a,* and is movable back and forth along a backside of a print ribbon R to transfer ink therefrom onto the substrate S as disclosed more fully in the copending application entitled "Bi-Directional Thermal Printer and Method Therefor" referenced hereinabove. More generally, however, the printer system 10 may be of any type, and the print head 20 may be a rotary, linearly, or stationary but thermally actuatable print head suitable for hot stamp or thermal or other types of printing.

A back-up plate 200 is actuatably and mountably disposed adjacent the print head access opening 110, wherein the back-up plate 200 is movable toward the print head access opening 110 and into engagement with the first perimeter 112 thereof to sealingly close the print head access opening 110 when the printer system 10 is not in use, whereby the print head 20 is sealingly enclosed within the housing 100 when the back-up plate 200 is engaged with the print head access opening 110. The back-up plate 200 includes generally a resilient member 202 disposed thereon to improved the effectiveness thereof during printing operations, and which also improves sealing between the back-up plate 200 and the housing 100. The back-up plate 200 is also movable away from the print head access opening 110 to a printing position to open the print head access opening 110 and support the substrate S during printing operations, which may be performed as discussed above.

FIGS. 1 and 2*a* illustrate the printer system 10 having a main plate assembly 30 mountably supporting the print head 20, and the housing 100 having a first opening 120 on the first side portion 101 thereof, wherein the main plate assembly 30 is preferably at least partially removably mountable in the housing 100 through the first opening 120. The first opening 120 is defined at least partially by substantially opposing first side portions 122 and 124 extending toward a first end portion 126 for accommodating a portion of the main plate assembly 30 to form a seal therebetween. FIG. 1 illustrates the main plate assembly 30 having an end portion 32 matably engageable with the first end portion 126 of the housing 100, and FIG. 2*a* illustrates the main plate assembly 30 having substantially opposing side portions 34 and 36 matably engageable with corresponding opposing side portions 122 and 124 of the housing 100. FIGS. 1 and 2*a* also illustrate the main plate assembly 30, and more particularly the side portions 34 and 36 and the end portions 32 and 38 thereof defining the print head access opening 110 when the main plate assembly 30 is mounted in the housing 100.

FIGS. 1, 2*a* and 2*b* illustrate a first resilient member 130 disposed on the first opening 120 in the housing 100, whereby the first resilient member 130 is matably engageable by the main plate assembly 30 at least partially mounted in the housing 100 to form the seal therebetween. FIG. 2*b* illustrates, in a preferred embodiment, the substantially opposing first side portions 122 and 124 tapering toward the first end portion 126 of the first opening 120 in the housing 100, wherein the substantially opposing side portions 34 and 36 of the main plate assembly 30 are similarly tapered, thereby providing optimum sealing therebetween.

FIG. 1 illustrates the printer system 10 further comprising a cassette assembly 40 mountably supporting a rewind reel 42 for drawing ribbon from an unwind reel. The cassette assembly 40 is removably mountable onto the main plate assembly 30, and more particularly the rewind reel 42 thereof is removably coupled to a rotary drive member 44 mounted on the main plate assembly 30 as discussed more fully in the copending application entitled "Bi-Directional Thermal Printer and Method Therefor" referenced hereinabove. In other embodiments, however, the rewind reel 42 is not necessarily coupled or removably coupled to the main plate assembly 30.

FIG. 1 illustrates the housing 100 having a cassette access opening 140 with a second perimeter 142 defining a second side portion 102 of the housing 100. The cassette assembly 40 is at least partially removably disposable in the housing 100 through the cassette access opening 140 thereof to removably mount the cassette assembly 40 onto the main plate assembly 30. In the exemplary embodiment of FIGS. 1 and 2*a*, the second perimeter 142 is defined by the housing 100 and by the main plate assembly 30, and is more particularly a closed perimeter portion defined partially by a top side portion 103 and opposing side portions 104 and 106 of the housing 100, and by the end portion 38 of the main plate assembly 30.

FIG. 1 illustrates the cassette assembly 40 having a side portion 46 matably engageable with the cassette access opening 140 in the housing 100 to form a seal therebetween. In the exemplary embodiment, a second resilient member 150 is disposed between the side portion 46 of the cassette assembly 40 and is engagable with the cassette access opening 140 in the housing 100 to form the seal therebetween. The second resilient member 150 is formed as a closed ended member adhered, or otherwise coupled, to either the cassette access opening 140 or the side portion 46 of the cassette assembly 40.

Figure 3:
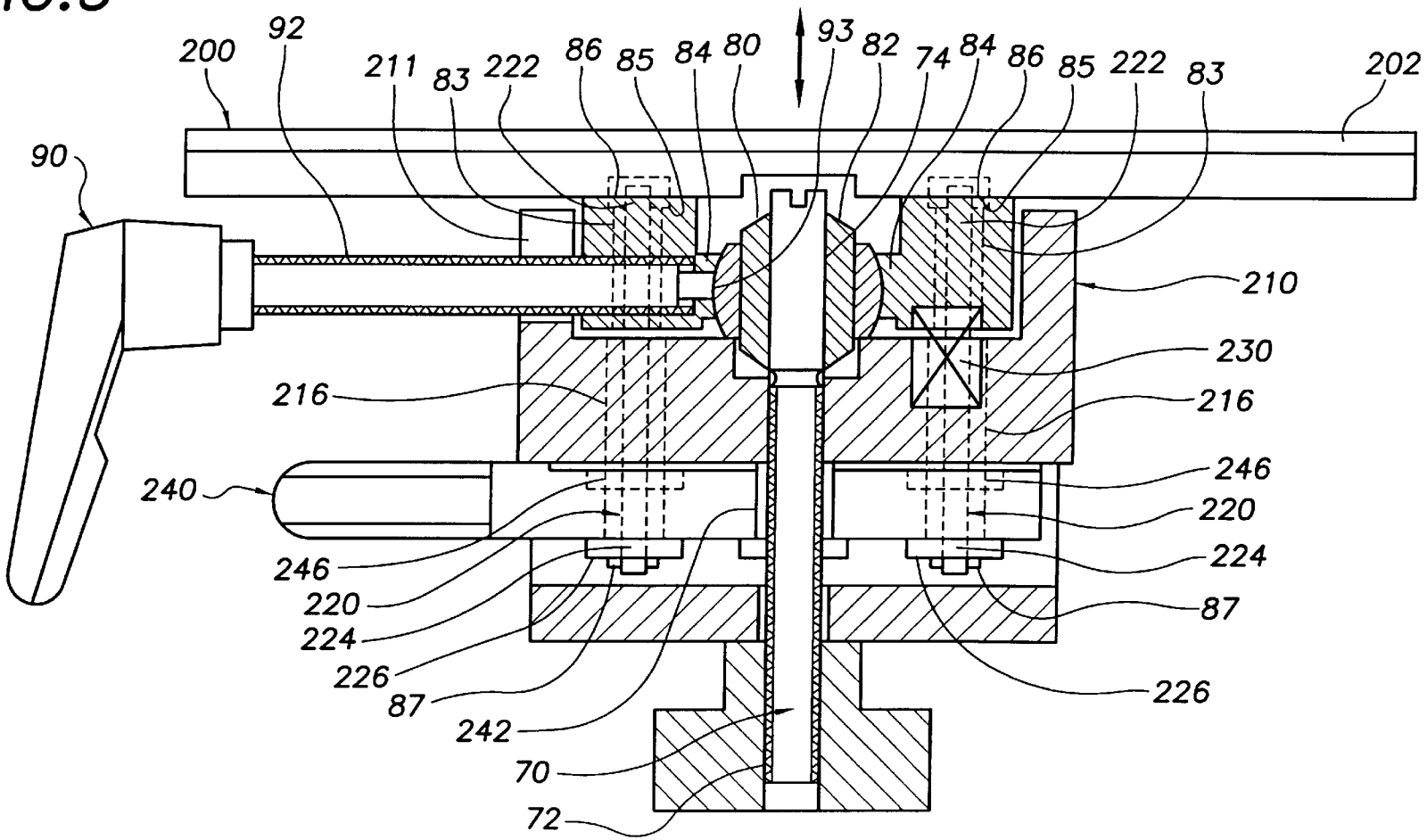
FIG. 3 is a partial sectional side view of a sealable and adjustable back-up plate according to an exemplary embodiment of the invention.
Figure 4:
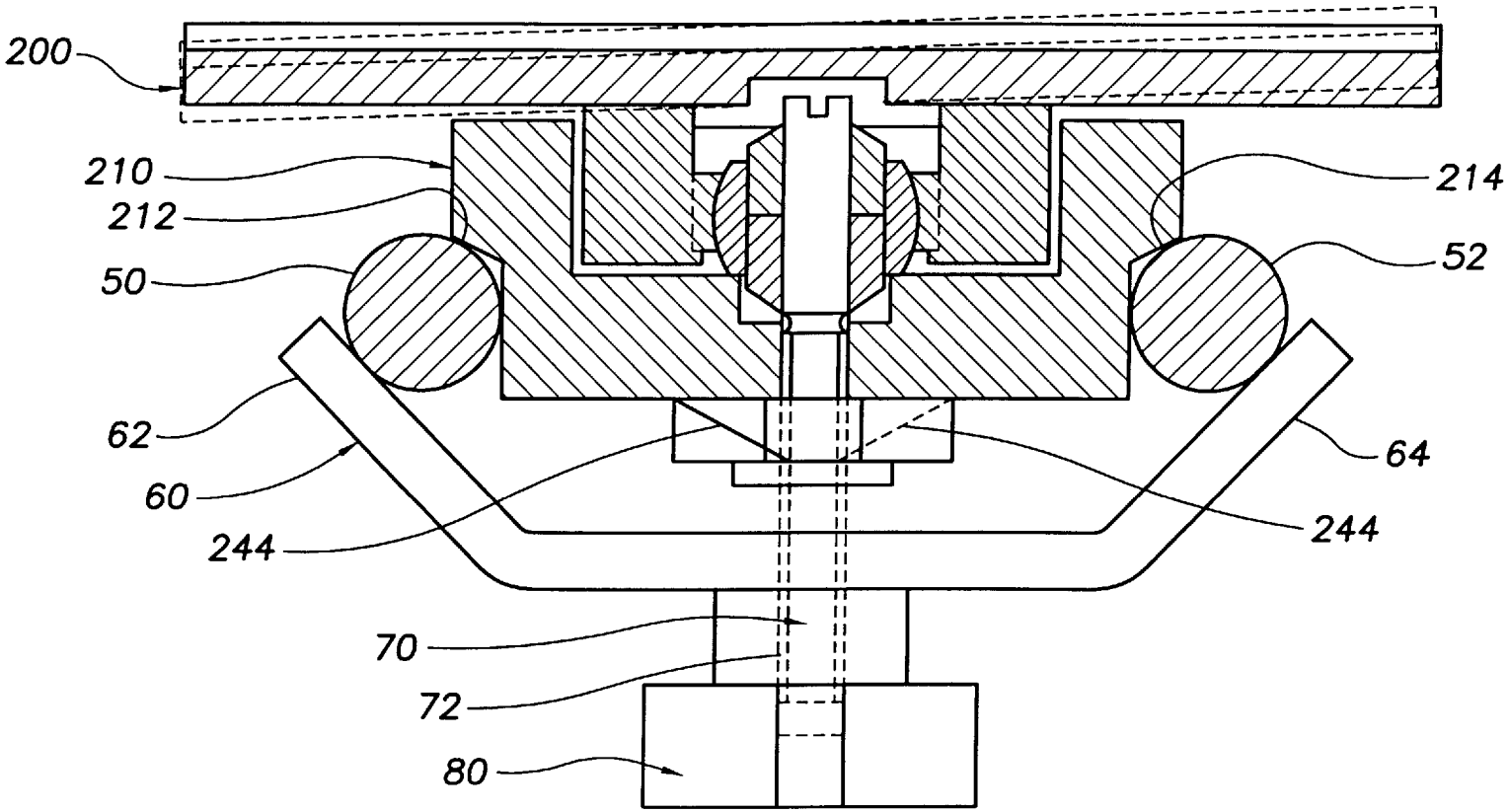
FIG. 4 is a partial sectional back elevational view of the sealable and adjustable back-up plate of FIG. 3.

FIGS. 3 and 4 illustrate the actuatable backup plate 200 movably coupled to a back-up housing 210, which is generally fixedly mounted relative to the housing 100. In the exemplary embodiment, the back-up housing 210 is clamped to support rods 50 and 52 by a clamping plate 60 movably disposed on a shaft 70 with a threaded end portion 72 upon rotating thereabout a threaded knob 80, which moves the clamping plate 60 toward and away from the back-up housing 210. The back-up housing 210 includes, more particularly, recesses 212 and 214 on opposing side portions thereof for seatingly receiving a corresponding one of the support rods 50 and 52, and the clamping plate 60 includes laterally disposed wings 62 and 64 engageable with the support rods 50 and 52 upon tightening the knob 80, thereby securely mounting the back-up housing 210 thereon. The back-up housing 210 is slidably mountable on the support rods 50 and 52, which permit accurate positioning and alignment of the back-up plate 200 relative to the housing 100, which is also similarly movably mounted preferably relative to the substrate S.

FIGS. 3 and 4 illustrate the actuatable back-up plate 200 movably coupled to the back-up housing 210, wherein the back-up plate 200 is biased toward the print head access opening 110 of the housing 100 and into engagement with the first perimeter 112 thereof to sealingly close the print head access opening 110, thereby protecting the printer system 10 disposed therein from environmental elements when not printing as discussed above. The back-up plate 200 is coupled to the back-up housing 210 by at least one and preferably two pull pins 220.

A biasing member biases the back-up plate 200 toward the print head access opening 110 and into engagement with the first perimeter 112 thereof to sealingly close the housing 100. In the exemplary embodiment, the biasing member includes preferably two compressed spring members 230, only one of which is shown, disposed between the back-up plate 200 and the back-up housing 210, whereby the back-up plate 200 is urged toward the print head access opening 110 of the housing 100 and is movable away therefrom to the printing position against the bias of the spring members 230 as discussed further below.

FIG. 3 illustrates a first end portion 222 of each pull pin 220 coupled to the backup plate 200 wherein the pull pins are movably extended through openings 216 through the back-up housing 210 so that a second end portion 224 of the pull pins 220 protrudes through the back-up housing 210 opposite the back-up plate 200, thereby guiding the back-up plate 200 as it moves with and against the bias of the spring members 230 toward and away from the housing 100, respectively.

FIGS. 3 and 4 illustrate a lever 240 pivotally coupled to the back-up housing 210. In the exemplary embodiment, more particularly, the lever 240 is pivotally coupled to the shaft 70 by a bearing or sleeve member 242 disposed thereabout, whereby the lever 240 is pivotal about the shaft 70. The lever 240 includes a tapered edge 244 and a corresponding slot 246 for accommodating each pull pin 220, whereby the lever 240 is pivotal, about the shaft 70, to wedgeably dispose the tapered edge 244 between a flange member 226 on the second end portion 224 of the pull pin 220 and the back-up housing 210. The back-up plate 200 is thus movable toward and away from the print head access opening 110 upon pivoting the lever 240 in one direction or the other about the shaft 70.

FIGS. 3 and 4 also illustrate a slide pin 74 extending from the shaft 70 fixedly coupled to the back-up housing 210 and protruding therefrom toward the back-up plate 200. A ball joint 80 includes an inner ball portion 82 coupled to the slide pin 74, and an outer pivot housing 84 adjustably coupled to the inner ball portion 82 and fixedly coupled to the backup plate 200, whereby the outer pivot housing 84 of the ball joint 80 is adjustably pivotable about the inner ball portion 82 to adjustably align the back-up plate 200 relative to the print head access opening 110.

In the exemplary embodiment, the pull pins 220 are disposed through corresponding enlarged openings 83 through the outer pivot housing 84 and enlarged openings 216 through the back-up housing 210, thereby permitting pivoting movement of the outer pivot housing 82 and the back-up plate 200 relative to the inner ball portion 82 and the back-up housing 210. Additionally, the first end portions 222 of the pull pins 220 are pivotally coupled to the outer pivot housing 84 by roll pins 86, which extend therethrough so that both ends of each roll pin 86 are supported on an edge 85 formed by a recess in one of the back-up plate 200 or the outer pivot housing 82 or therebetween, as shown. Similarly, the flanges, or washers 226, on the second end portions 224 of the pull pins 220 are retained thereon by roll pins 87. The roll pins provide a high degree of movement for the back-up plate 200 relative to the back-up housing 210 during alignment of the back-up plate 200. Alternatively, the roll pins 86 and 87 may be replaced by clip washers or other retaining members.

FIG. 3 illustrates an adjustment handle 90 having an at least partially threaded shaft 92 disposed through an opening 211 in the outer pivot housing 210, and extendable through and threadably engageable with the outer pivot housing 84. An end portion 93 of the shaft 92 is lockingly engagable with the inner ball portion 82 of the ball joint 80 to fix the alignment of the back-up plate 200 and the outer pivot housing 84 relative thereto. The opening 211 through the back-up housing 210 permits movement of the shaft 92 relative to the back-up housing 210 during alignment of the back-up plate 200. The inner ball portion 82 of the ball joint 80 is axially movable along the slide pin 74 to permit positioning of the back-up plate 200 toward and away from the print head access opening 110 of the housing 100 upon pivoting actuation of the lever 240, as discussed above.

In operation, the adjustment handle 90 is loosened to disengage the end portion 93 thereof from the inner ball portion 82 to permit alignment of the back-up plate 200 relative to the housing 100, and more particularly relative to the print head 20 therein, thereby ensuring proper ink transfer from the ribbon onto the substrate S. The back-up plate 200 is aligned with the print head 20 by aligning the back-up plate 200 relative to the print head access opening 110, which is configured for aligning the back-up plate 200 relative to the print head 20. More particularly, after loosening the adjustment handle 90, the back-up plate 200 is moved toward and into engagement with the print head access opening 110 by pivoting the lever 240. The end portion 93 of the threaded shaft 92 is next tightened to engage the inner ball portion 82, thereby fixing alignment of the back-up plate 200. The aligned back-up plate is then moved away from the housing 100 to the print position upon pivoting the lever 240.

While the foregoing written description of the invention enables one of ordinary skill in the art to make and use what is at present considered to be the best mode of the invention, it will be appreciated and understood by those of ordinary skill the existence of variations, combinations, modifications and equivalents within the spirit and scope of the specific exemplary embodiments disclosed herein. The present invention is therefore to be limited not by the specific exemplary embodiments disclosed herein but by all embodiments within the scope of the appended claims.

What is claimed is:

1. A printer system useable for printing onto a substrate, the systems comprising:

a housing;

a print head disposed in the housing;

a print head access opening having a first perimeter on a first side portion of the housing;

an actuatable back-up plate mountably disposed adjacent the print head access opening, the back-up plate movable toward the print head access opening and into engagement with the first perimeter to sealingly close the print head access opening, and the back-up plate movable away from the print head access opening of the housing to a printing position to open the print head access opening, whereby the print head is sealingly enclosed within the housing when the back-up plate is engaged with the print head access opening thereof.

2. The printer system of claim 1 further comprising a main plate assembly mountably supporting the print head, a first opening on the first side portion of the housing defined at least partially by substantially opposing first side portions extending toward a first end portion, the main plate assembly at least partially removably mountable in the housing, whereby a portion of the main plate assembly is matably engageable with at least a portion of the first opening in the housing to form a seal therebetween.

3. The printer system of claim 2, the substantially opposing first side portions tapering toward the first end portion of the first opening in the housing, a first resilient member disposed on the first opening in the housing, whereby the first resilient member is matably engageable by the main plate assembly to form the seal therebetween.

4. The printer system of claim 2 further comprising a cassette assembly mountably supporting a rewind reel for drawing ribbon from an unwind reel, the cassette assembly removably mountable onto the main plate assembly, a cassette access opening having a second perimeter on a second side portion of the housing, the second perimeter defined by the housing and by the main plate assembly, the cassette assembly at least partially removably disposeable in the housing to removably mount the cassette assembly onto the main plate assembly, whereby a portion of the cassette assembly is matably engageable with the cassette access opening in the housing to form a seal therebetween.

5. The printer system of claim 4 further comprising a second resilient member disposed between the cassette assembly and cassette access opening in the housing, whereby the second resilient member forms the seal.

6. The printer system of claim 1 further comprising a back-up housing fixedly mounted relative to the housing, the actuatable back-up plate movably coupled to the back-up housing and biased toward the print head access opening and into engagement with the first perimeter to sealingly close the print head access opening.

7. The printer system of claim 1 further comprising:

a back-up housing fixedly mounted relative to the housing;

a pull pin having a first end portion coupled to the backup plate and a second end portion coupled to the back-up housing;

a biasing member biasing the back-up plate toward the print head access opening and into engagement with the first perimeter to sealingly close the print head access opening, whereby the back-up plate is movable away from the print head access opening to the printing position against the bias of the biasing member.

8. The printer system of claim 7, the biasing member is a compressed spring member disposed between the back-up plate and the back-up housing, the spring member urging the back-up plate away from the back-up housing and toward the print head access opening.

9. The printer system of claim 7, the pull pin movably extending through the back-up housing so that the second end portion of the pull pin protrudes through the back-up housing opposite the back-up plate, a flange member disposed on the second end portion of the pull pin, a lever pivotally coupled to the back-up housing, the lever having a tapered edge, whereby the lever is pivotal to wedgeably dispose the tapered edge between the flange member and the back-up housing to move the back-up plate away from the print head access opening.

10. The printer system of claim 1 further comprising:

a back-up housing fixedly mounted relative to the housing;

a slide pin fixedly coupled to the back-up housing and protruding from the back-up housing toward the backup plate;

a ball joint having an inner ball portion coupled to the slide pin, the ball joint having an outer pivot housing adjustably coupled to the inner ball portion and fixedly coupled to the backup plate, whereby the outer pivot housing of the ball joint is adjustably pivotable about the inner ball portion to adjustably align the back-up plate relative to the print head access opening.

11. The printer system of claim 10 further comprising an adjustment handle having a threaded shaft extendable through and threadably engagable with the outer pivot housing to lockingly engage an end portion of the threaded shaft with the inner ball portion, whereby the alignment of the back-up plate is fixed.

12. The printer system of claim 10, the inner ball portion of the ball joint axially movable along the slide pin to permit positioning the back-up plate toward and away from the print head access opening.

13. A method for printing onto a substrate, the method comprising:

actuatably disposing a print head in a housing;

actuating the print head to transfer print from the ribbon onto a portion of substrate disposed between the print head and a back-up plate separated from the print head;

moving the back-up plate toward a print head access opening on a first side portion of the housing and into engagement with a first perimeter of the print head access opening to sealingly close the print head access opening when not printing, whereby the print head is sealingly enclosed within the housing when the back-up plate is engaged with the print head access opening thereof.

14. The method of claim 13 further comprising at least partially removably mounting a main plate assembly supporting the print head in a first opening on the first side portion of the housing, the first opening defined at least partially by substantially opposing first side portions extending taperingly toward a first end portion, and matably engaging at least a portion of the main plate assembly with at least a portion of the first opening in the housing to form a seal therebetween.

15. The method of claim 14 further comprising at least partially removably disposing a cassette assembly supporting a rewind reel for drawing ribbon from an unwind reel in the housing to removably mount the cassette assembly onto the main plate assembly, and matably engaging a portion of the cassette assembly with a cassette access opening having a second perimeter defined by the housing and by the main plate assembly to form a seal about the cassette access opening.

16. The method of claim 13 further comprising biasing the back-up plate toward the print head access opening and into engagement with the first perimeter to sealingly close the print head access opening.

17. The method of claim 16 further comprising moving the back-up plate away from the print head access opening by engaging a flanged end of a pull pin with a tapered edge of a pivotal lever wedgeably disposeable between the flange end and a back-up housing, whereby the pull pin is coupled to the back-up plate and extend through the back-up housing.

18. The method of claim 13 further comprising adjustably aligning the back-up plate relative to the print head access opening by pivoting an outer pivot housing fixedly coupled to the back-up plate relative to an inner ball portion of a ball joint, and fixing alignment of the back-up plate by engaging an end portion of a threaded shaft with the inner ball portion.

19. The method of claim 18 further comprising aligning the back-up plate relative to the print head access opening by moving the back-up plate toward and into engagement with the print head access opening, and then engaging the end portion of the threaded shaft with the inner ball portion to fix the alignment of the back-up plate.

20. The method of claim 18, moving the inner ball portion of the ball joint axially along a slide pin fixedly coupled to a back-up housing to position the back-up plate toward and away from the print head access opening.

* * * * *